United States Patent [19]

Evans

[11] Patent Number: 4,844,105

[45] Date of Patent: Jul. 4, 1989

[54] SPRAY TREATMENT APPARATUS FOR COKE OVEN DOOR STRUCTURES

[75] Inventor: Joseph M. Evans, Export, Pa.

[73] Assignee: Silicon Technology, Inc., Pittsburgh, Pa.

[21] Appl. No.: 261,141

[22] Filed: Oct. 24, 1988

[51] Int. Cl.[4] ..... B08B 3/02

[52] U.S. Cl. ..... 134/57 R; 134/172; 134/180; 134/181; 202/241; 201/2; 118/305; 118/323

[58] Field of Search ..... 134/57 R, 58 R, 99, 134/167 R, 172, 180, 181, 198; 202/241; 201/2; 118/305, 323, 326

[56] References Cited

U.S. PATENT DOCUMENTS

| | | | |
|---|---|---|---|
| 3,577,321 | 5/1971 | Schaten | 202/241 |
| 3,605,155 | 9/1971 | McCullough et al. | 15/93 |
| 3,609,786 | 10/1971 | Stanke et al. | 15/93 |
| 3,611,466 | 10/1971 | McCullough et al. | 15/93 |
| 3,633,232 | 1/1972 | McCullough et al. | 15/93 |
| 3,758,910 | 9/1973 | Lakeberg | 15/93 |
| 3,774,258 | 11/1973 | Moreau | 15/93 |
| 3,822,191 | 7/1974 | Konno | 202/241 |
| 3,847,753 | 11/1974 | Baird et al. | 202/241 |
| 3,955,232 | 5/1976 | Konno | 15/93 |
| 3,971,092 | 7/1976 | Stanke et al. | 15/93 |
| 4,000,043 | 12/1976 | Irwin | 202/241 |
| 4,025,979 | 5/1977 | Stanke et al. | 15/93 |
| 4,080,220 | 3/1978 | Neumann | 202/241 X |
| 4,097,304 | 6/1978 | Taylor | 134/6 |
| 4,097,340 | 6/1978 | Pries | 134/180 X |
| 4,110,171 | 8/1978 | Baird et al. | 202/241 |
| 4,151,852 | 5/1979 | Lisles | 134/168 |
| 4,165,261 | 8/1979 | Henstra et al. | 202/241 |
| 4,201,630 | 5/1980 | Hyde | 202/241 |
| 4,243,490 | 1/1981 | Tsuzuki et al. | 202/241 |
| 4,259,760 | 4/1981 | Harris | 15/93 |
| 4,259,921 | 4/1981 | Wallsten . | |
| 4,300,257 | 11/1981 | Ibe et al. | 202/241 |
| 4,300,986 | 11/1981 | Akira et al. | 202/241 |
| 4,339,481 | 7/1982 | Beekhuis . | |
| 4,672,705 | 6/1987 | Bors et al. . | |

FOREIGN PATENT DOCUMENTS

| | | |
|---|---|---|
| 0137089 | 4/1985 | European Pat. Off. . |
| 1120950 | 12/1961 | Fed. Rep. of Germany . |
| 7604531 | 9/1976 | France . |
| 7931337 | 7/1980 | France . |

*Primary Examiner*—Frankie L. Stinson

*Attorney, Agent, or Firm*—Fleit, Jacobson, Cohn & Price

[57] ABSTRACT

An apparatus for cleaning and sealing the peripheral knife edge of a coke oven door has a vertical mast which is positioned adjacent one edge of a door suitably supported in vertical position on a door rack. A treatment carriage in the form a horizontal arm is mounted for vertical reciprocation along the mast. Spray heads are mounted on an endless conveyor chain looped around turning point sprockets at opposite ends of the treatment carriage. The diameter of the turning point sprockets and the distance therebetween are related to the curvature of the corners of the door and the width of the door so that as the drive chain traverses the upper part of its endless run the spray heads can spray a path corresponding to the profile of the top edge of the door and the curved corners at opposite ends thereof. Correspondingly, when the chain proceeds along the lower part of its run, the spray heads can transverse a path corresponding to the profile of the lower edge of the door and the curved corners at its opposite ends. A reciprocal drive is provided for moving the treatment carriage up and down along the mast. When the treatment carriage moves up the mast an inner edge of the door is treated and when the carriage moves down the mast an outer edge of the door is treated. Controls are provided for effecting either a cleaning cycle, a sealing cycle or a cleaning cycle followed by a sealing cycle.

10 Claims, 9 Drawing Sheets

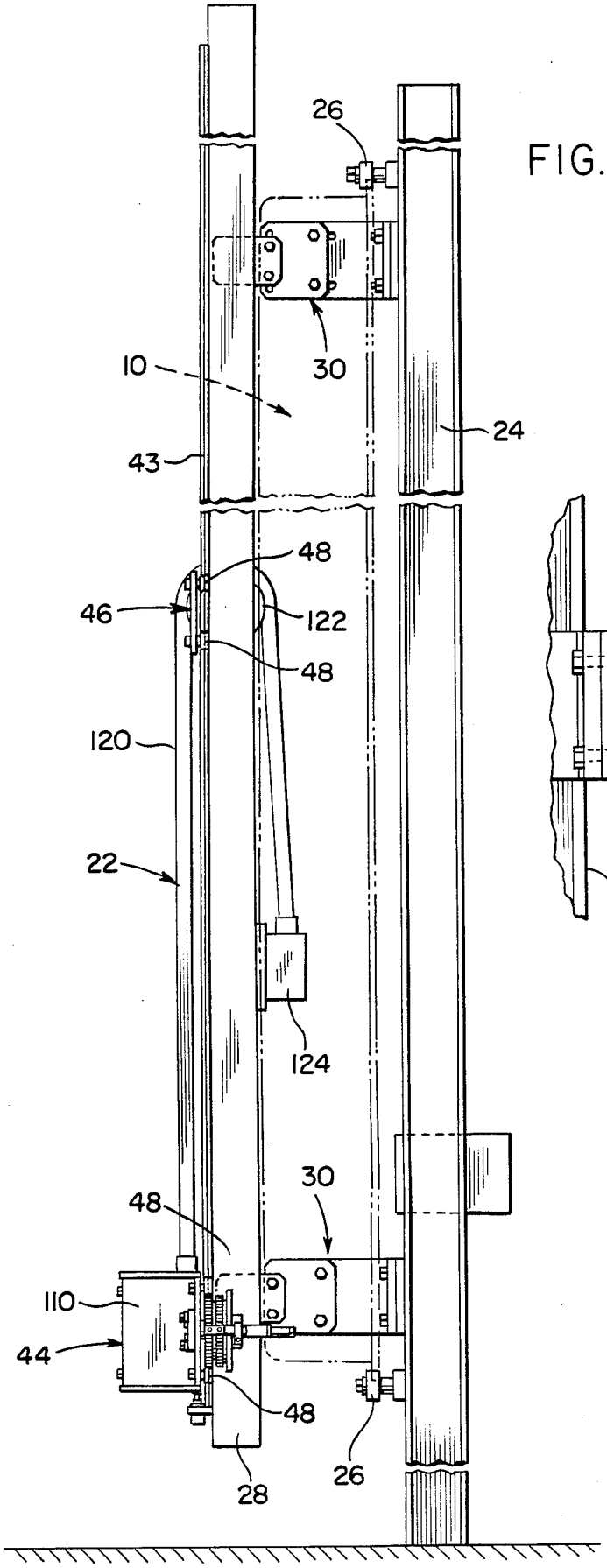
FIG. 2
FIG. 10
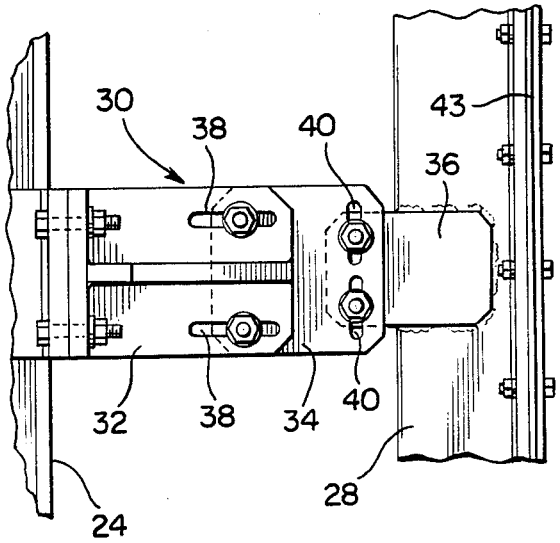

SPRAY TREATMENT APPARATUS FOR COKE OVEN DOOR STRUCTURES

BACKGROUND OF THE INVENTION

This invention relates to a treatment apparatus for coke oven door structures.

The sealing surfaces of coke oven doors and door jambs tend to become dirty in use due to condensation of coal tars and the like o the sealing surfaces thereof. If the condensed material is allowed to build up, it will eventually interfere with the door seal allowing coke oven gas to escape from the oven. Accordingly, it is common practice periodically to clean the sealing surfaces of the door structures.

Removal of the carbonized tars from the door sealing surfaces has in the past presented certain difficulties. For example, manual cleaning performed with a chisel cleaning tool can be inefficient and often damaging to a door seal. Semiautomatic mechanical cleaners which scrape or brush the door seal sealing surfaces are an improvement over manual cleaning but can also be damaging to the sealing surfaces. High pressure water jets or sprays have been found to effectively clean doors and reduce damage to the sealing surfaces but the design of effective spray equipment also presents certain difficulties.

Thus, for example, although coke oven doors and door jambs are generally rectangular in shape, they commonly have sealing structures with rounded corners. Thus, simple rectangular motion, for example, of a spray cleaning head or the like around the periphery of a door structure would not effectively clean the rounded corners. In order to move a cleaning head around the corners of a door structure as well as vertically and horizontally along the respective door edges, known spray-cleaning machines have, for example, incorporated a massive frame shaped to conform to the shape of a door and around which a spray head is moved during a spray cleaning operation. Other known door cleaning proposals have likewise involved complex equipment for enabling cleaning heads to conform to a door profile.

SUMMARY OF THE INVENTION

It is an object of the invention to provide treatment apparatus particularly adapted for cleaning and/or sealing the sealing surfaces of coke oven door structures, which is compact and relatively lightweight compared with known forms of such apparatus and which is capable of semi-automatic cleaning and sealing of rectangular doors and door jambs having rounded corners.

A further object of the invention is to provide a treatment machine for coke oven door structures which includes means for selectively cleaning a door sealing surface or door jamb to remove carbonaceous material and or directing a sealant spray onto the door or jam for applying a sealant to the sealing surfaces.

A still further object of the invention is to provide a relatively compact and lightweight machine for treating coke oven door structures which can be used selectively either only to clean the sealing surfaces, only to seal the sealing surfaces with a suitable sealant or alternatively to both clean and sequentially seal the respective surfaces.

In fulfillment of the above and other objects, the invention accordingly provides a treatment machine for coke oven door structures which includes a vertically reciprocal treatment carriage mounted for movement on suitable guides along a vertical mast. The treatment carriage is substantially in the form of a horizontal arm having a length approximating the width of a door to be treated. On the arm is mounted an endless conveyor chain around turning point sprockets, or the like, with the diameter of the sprockets being related to the radius of curvature of the rounded corners of door to be cleaned and the distance between the sprockets being related to the width of the door itself. The conveyor chain carries one or more treatment heads, for example, a spray cleaning head and a spray sealant head for treating the door sealant surfaces.

Drive mechanisms are provided for moving the treatment carriage along the mast and for operating the conveyor chain respectively. For example, a hydraulic piston-cylinder assembly may be mounted on the mast to provide vertical motion of the treatment carriage. The cylinder may, for example, be associated with a second carriage on which is mounted a chain pulley. One end of a drive chain wound around the pulley may be fixed to the mast and the other end of the chain fixed to the treatment carriage whereby extension or retraction of the cylinder provides vertical movement of the treatment carriage at two times the rate of the vertical extension or retraction of the piston. The conveyor chain on the carriage may, for example, be driven by a fluid motor or the like under the control of limit switches.

In a cleaning cycle, the cleaning carriage may commence operation at the base of a door and may be moved upwardly along the mast by extension of the hydraulic cylinder in order to clean an inner vertical edge of the door structure. When the carriage has reached the top of the door, a limit switch or the like may be tripped to terminate upward movement of the carriage and actuate the drive means for the carriage conveyor. In this position the respective treatment head will be at the innermost turning point of the conveyor chain and commencement of the conveyor operation will cause the treatment head to move in a circular path 90° around the inner chain sprocket which path substantially conforms to the profile of the inner upper corner of the door structure. Continued operation of the conveyor chain will cause the treatment head to traverse the width of the door and then traverse a 90° turn around the outer sprocket effectively conforming to the upper outer rounded corner of the door structure. At this point, a further limit switch or the like will terminate operation of the carriage conveyor and initiate retraction of the mast cylinder for moving the carriage down the length of the door whereby the treatment head will treat the outer vertical door edge.

When the treatment carriage reaches the bottom of the door, a still further limit switch will be tripped to terminate its vertical descent and again operate the carriage conveyor to bring the treatment head initially around the lower outer corner of the door structure along the lower edge of the door and around the inner lower corner of the structure back to the initial starting point of the cycle.

If the carriage includes, for example, both a cleaning head and a sealing head, the cycle may be repeated accordingly.

A machine in accordance with the invention has a size and weight which may be reduced by at least 50% compared with known machines along with a lower initial cost and simpler installation.

Additional features and advantages of the invention will be apparent from the ensuing description and claims read in conjunction with the accompanying drawings.

BRIEF DESCRIPTION OF DRAWINGS

FIG. 2 is a side elevational view of the machine.

FIG. 10 is a front elevational view of a mounting bracket.

DESCRIPTION OF PREFERRED EMBODIMENT

Figure 1:
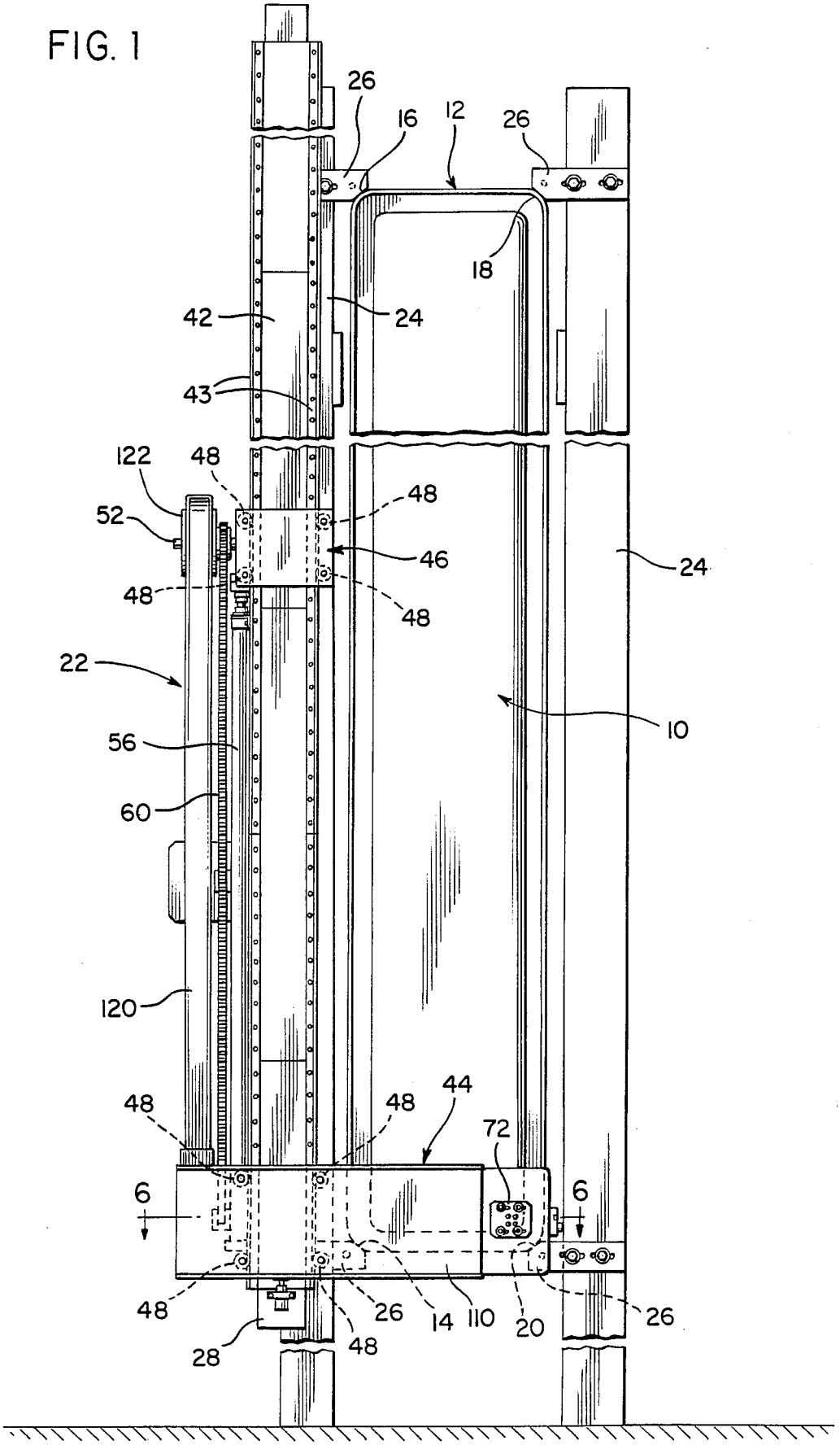
FIG. 1 is a front elevational view of a treatment machine in accordance with the invention for the spray treatment of coke oven door structures.
Figure 3:
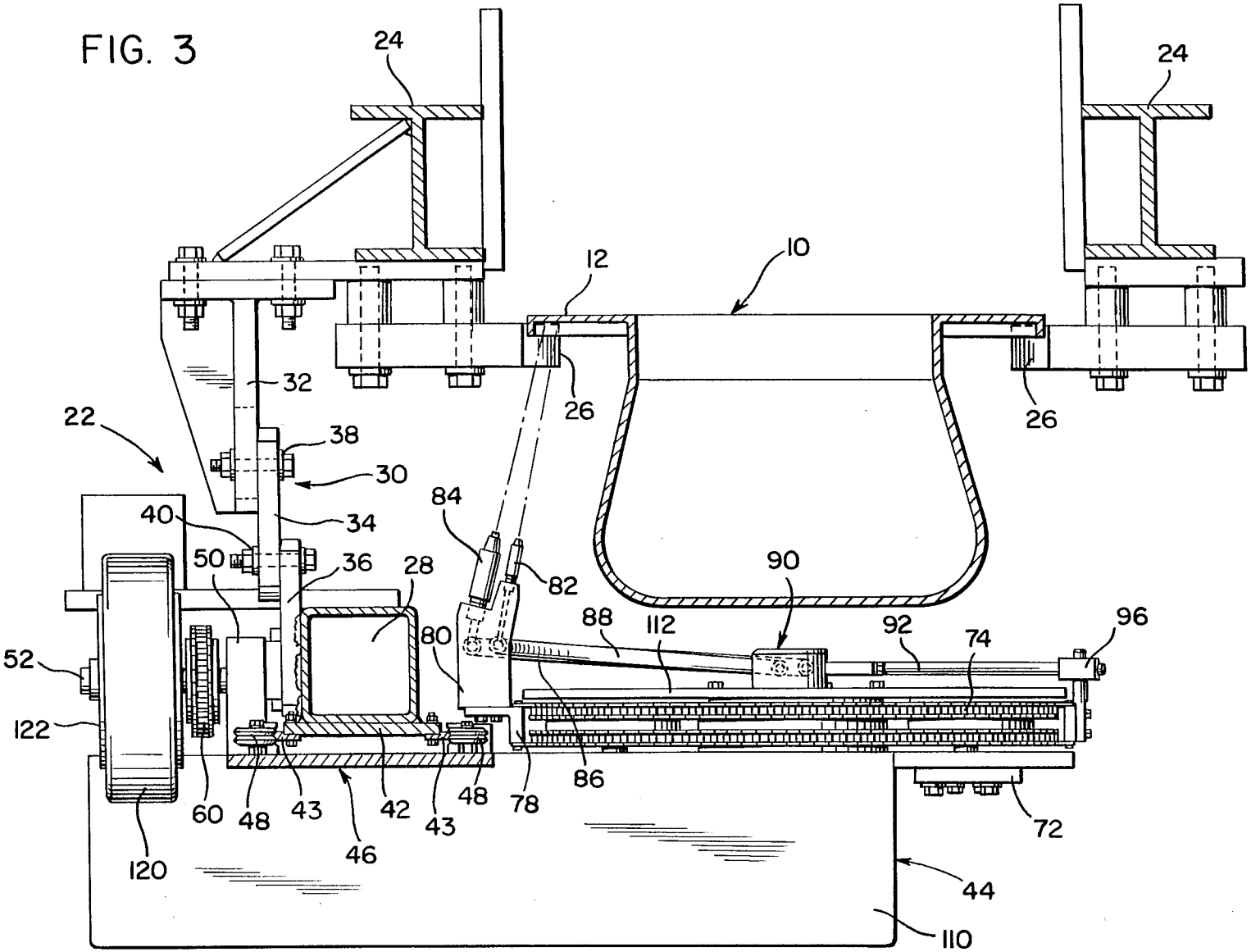
FIG. 3 is an enlarged part sectional plan view of the machine.

Referring initially to FIGS. 1, 2, 3 and 10 there is shown therein a coke oven door 10 having a peripheral knife edge 12 with rounded corners 14, 16, 18 and 20, the door being mounted on a door rack structure (to be described) for spray treatment of the knife edge, for cleaning and/or seal-applying purposes, by a spray treatment machine in accordance with the invention, the machine being generally indicated by reference numeral 22. The door rack structure may, for example, comprise spaced vertical columns 24 with upper and lower door stops 26 between which the door is mounted, in known manner, for spray treatment of the knife edge. It is understood that the present invention is primarily concerned with the construction and operation of the spray treatment apparatus 22, whereas the rack structures 24 and stops 26 may be conventional items which do not form part of the invention. The door, may, alternatively, be supported for spray treatment by any suitable support means.

The treatment machine 22 includes a hollow rectangular vertical mast 28 which is carried on one of the columns 24 by means of upper and lower adjustable mounting bracket structures 30. As shown in FIG. 10, each mounting bracket structure may comprise a plurality of plates 32, 34, 36 with slotted connections 38 and 40 for providing horizontal and vertical adjustments of mast 28 relative to column 24.

On the front of the mast 28 there is mounted a vertical plate 42 with bolted-on vertical edge elements 43 which form guides for a vertically reciprocal spray carriage 44 and a vertically reciprocal lift carriage 46. The carriages 44 and 46 have respective rollers 48 which embrace the edge elements 43 to guide the carriages vertically along mast 28. The spray carriage 44 carries spray equipment, to be described below, for the spray treatment of the knife edge 12 of door 10 and the lift carriage 46 is provided for driving the spray carriage in its up and down movement as will now be described.

Figure 7:
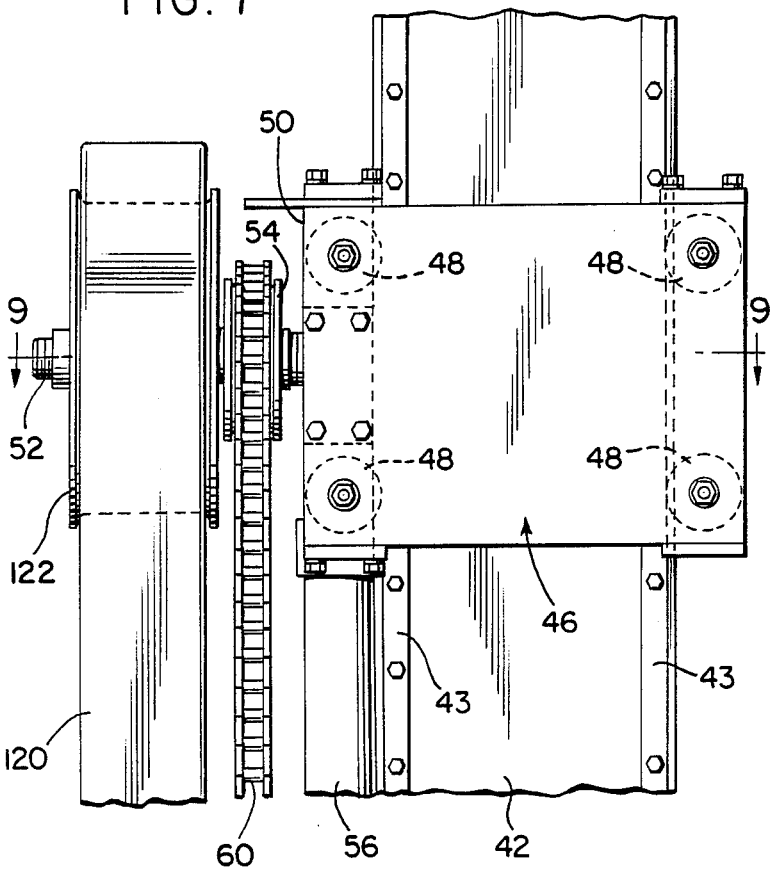
FIG. 7 is an enlarged front elevational view of a drive carriage of the machine.
Figure 8:
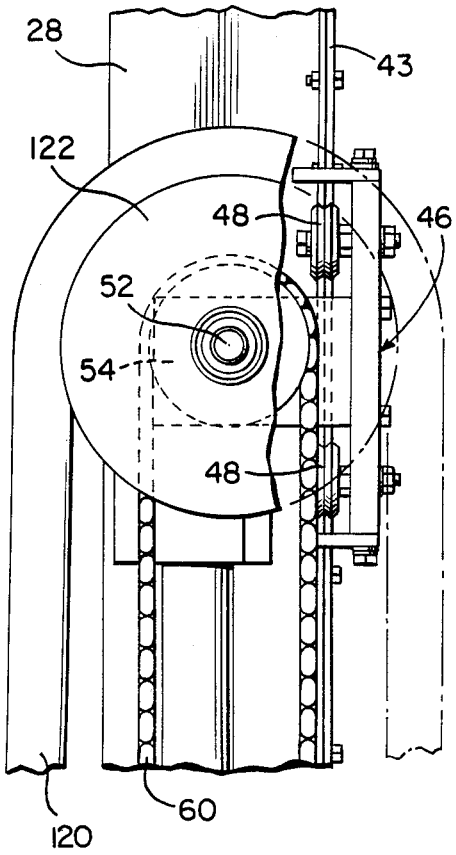
FIG. 8 is a side elevational view of the drive carriage.
Figure 9:
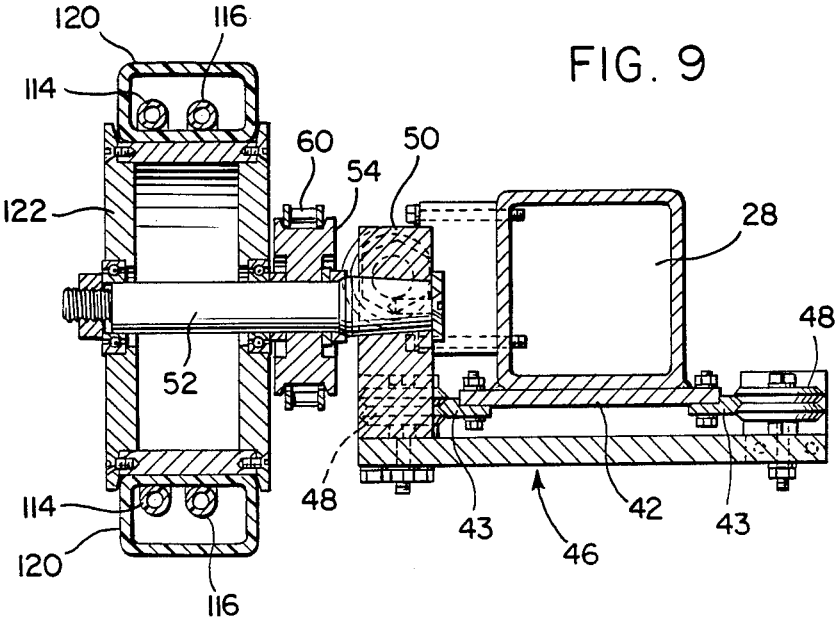
FIG. 9 is a sectional view on line 9—9 of FIG. 7.

As shown in more detail in FIGS. 7–9, the lift carriage 46 has a side plate 50 carrying an outwardly extending shaft 52. A chain sprocket 54 is carried at the inner end of shaft 52. Further secured to side plate 52 is the upper end of an extensible and retractable hydraulic drive cylinder assembly 56, the lower end of which is secured to mast 28 by a suitable bracket such as bracket 58 shown in FIG. 4. A drive chain 60 is trained around sprocket 54 and has one end thereof secured to the spray carriage 44 by means of a bracket 61 (FIGS. 4 and 5) while the other end of the chain is suitably secured to mast 24 in a manner not shown in the drawings.

The arrangement of the drive cylinder 56, and the chain 60 is such that extension of the cylinder causes the spray carriage 44 to be moved upwardly along mast 24 at two times the rate of movement of the lift carriage 46. Similarly, retraction of the cylinder causes the spray carriage to descend at the twice rate of the lift carriage. The geometry of the drive mechanism and height of mast 28 is such that within the stroke of the cylinder 56 the spray carriage can be raised and lowered between levels substantially corresponding to the bottom and the top of door 10.

Figure 4:
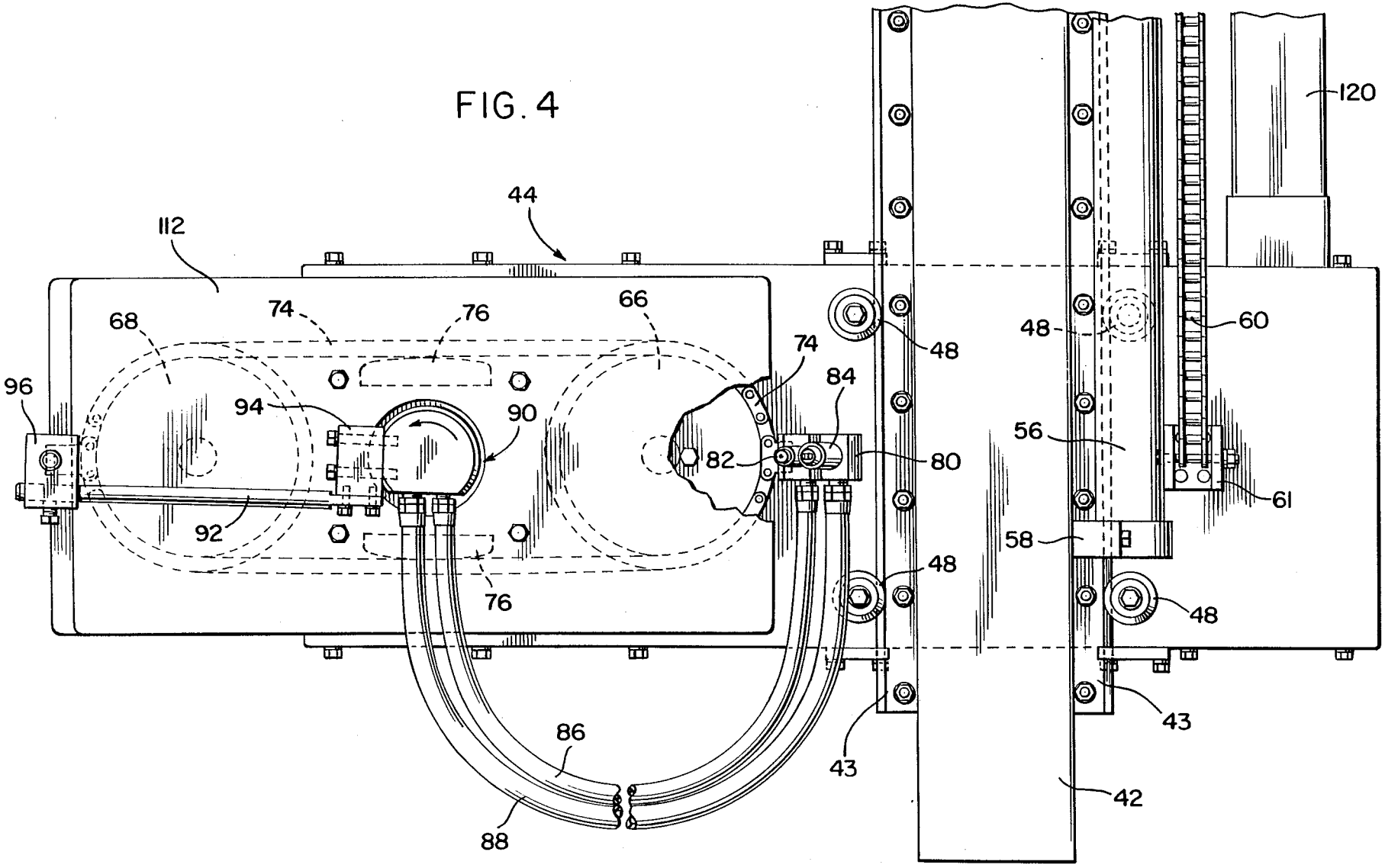
FIG. 4 is a still further enlarged front elevational view of a treatment carriage of the machine.
Figure 5:
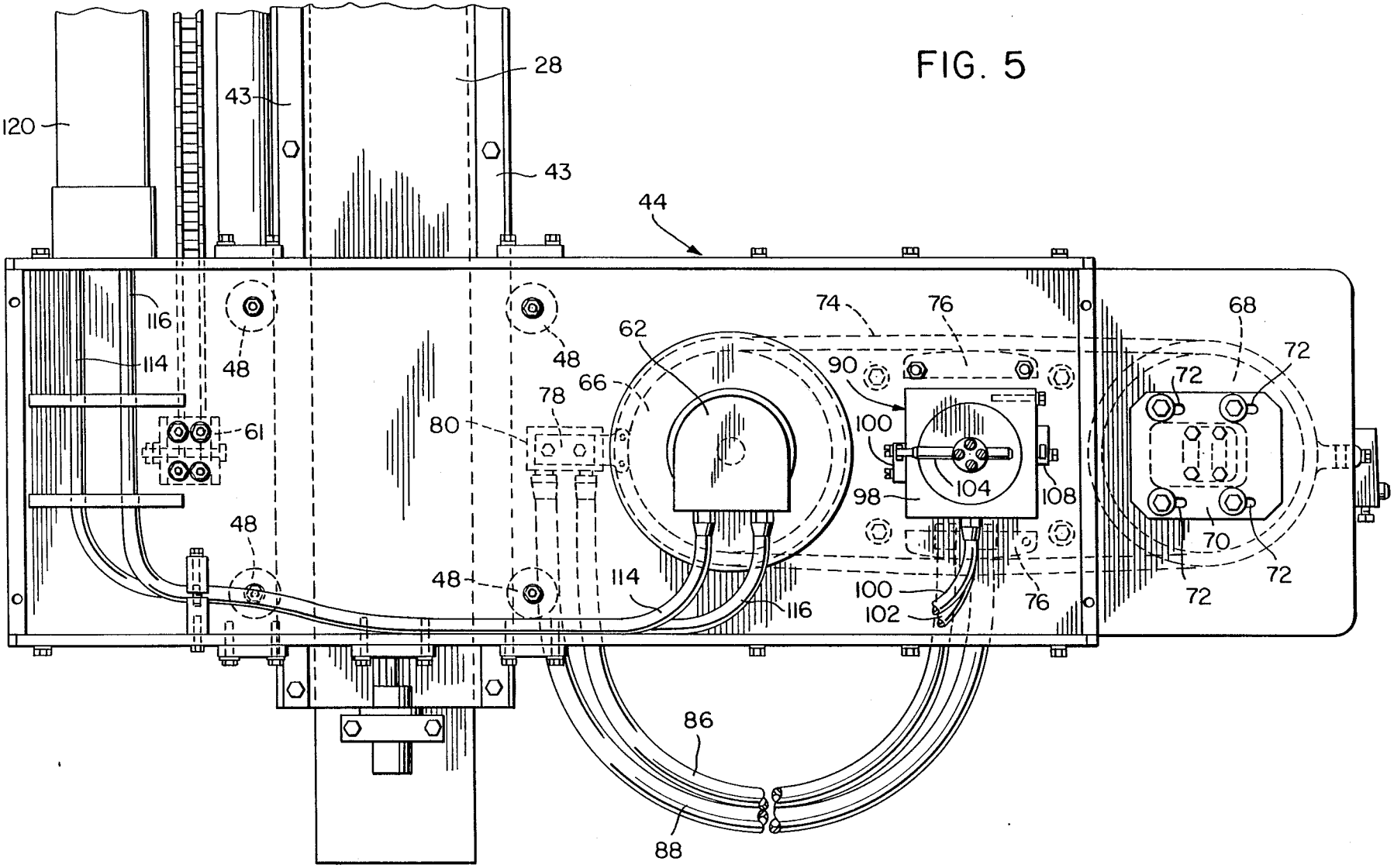
FIG. 5 is a rear elevational view of the treatment carriage.
Figure 6:
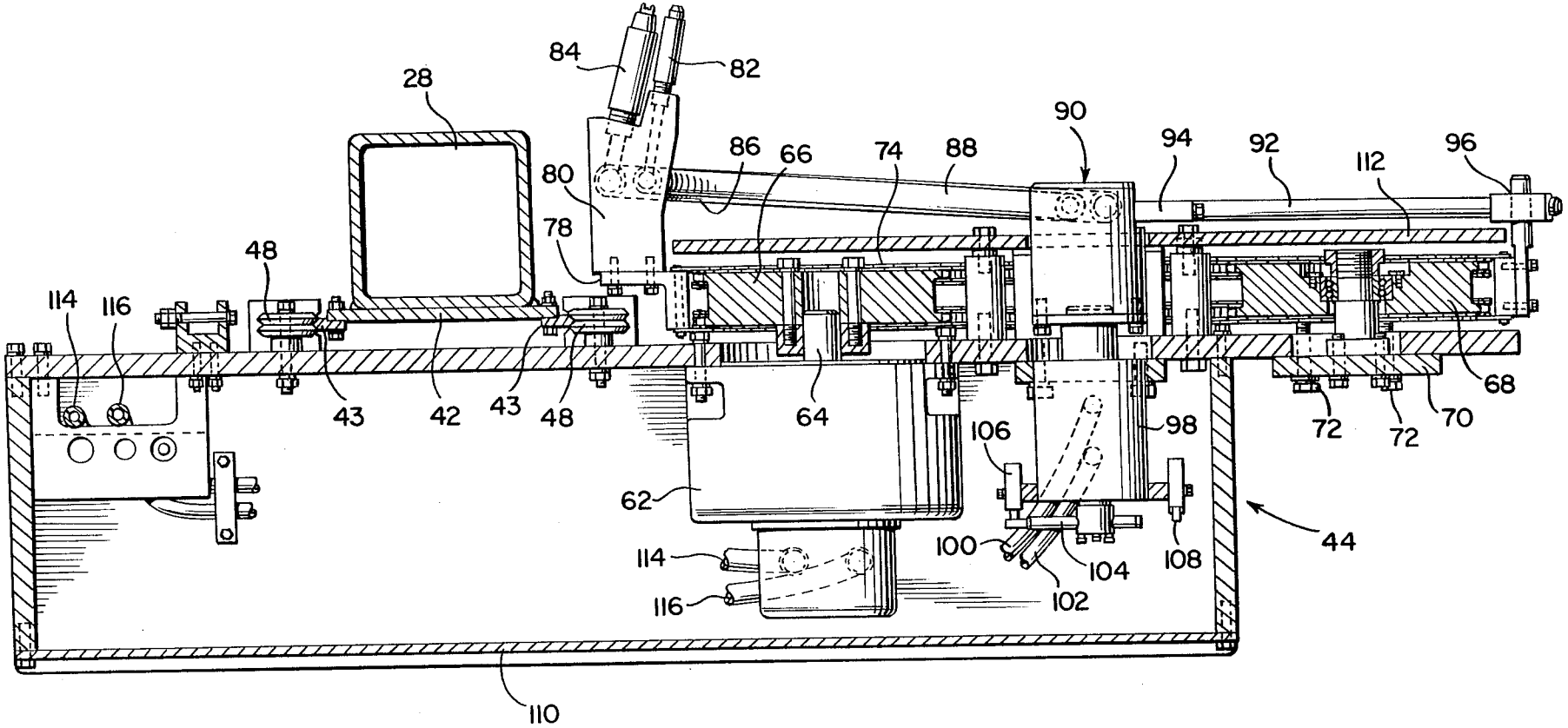
FIG. 6 is a sectional plan view of the treatment carriage.

Referring now more particularly to FIGS. 4 to 6, there are shown the details of the spray carriage 44. Mounted on the front surface of the carriage 44 is a hydraulic drive motor 62 with an output shaft 64 to which is secured a chain drive sprocket 66 at the back of the carriage. Also mounted on the back of the carriage is an idler sprocket 68, the idler sprocket being mounted in an adjustable plate 70 which has slotted attachments 72 enabling the position of the idler sprocket to be somewhat adjusted relative to the drive sprocket. An endless spray head drive chain 74 is trained around the respective sprockets. Chain tensioning guide plates 76 may also be provided on the back surface of carriage 44. One link of the chain 74 carries a bracket 78 on which is mounted a spray head manifold 80 with a water spray head 82 and a sealant spray head 84 for respectively spraying cleaning water and foam sealant around the perimeter of the door knife edge. The manifold contains suitable ducting for supplying the spray heads with liquid through respective water and sealant hoses 86, 88 which are supplied by a rotary union 90. The union itself is rotated by a union drive arm 92 attached at one end to a union bracket 94 secured to the union and at its outer end to an arm coupling 96 attached to another link of chain 74 opposite the link to which the respective spray heads are attached.

It is evident from the foregoing that when the hydraulic motor 62 is actuated to rotate sprocket 66, the chain 74 will move around a closed loop defined by the respective sprockets 66, 68 thereby also moving the spray heads 82, 84 in an equivalent loop profile. The diameter of the sprockets and the spacing therebetween are related to the configuration of the upper and lower edges of door 10 in a manner enabling the sprays produced by the respective spray heads 82 and 84 to follow the profiles of the curved corners and upper and lower edges of the door knife edge. Clearly, the upper loop of the profile defined by the travel of the spray heads conforms to the upper edge and corners of the door while the upper loop of the profile conforms to the lower edge profile of the door. It is equally evident that rotation of the chain 74 will, through the drive arm 92, cause the rotary union 90 to rotate to provide movement of the hoses 86 and 88 compensating the movement of the spray heads along the upper and lower loops of the chain profile.

Water and spray sealant under pressure are supplied to a stationary part 98 the rotary union which is attached to the forward surface of the spray carriage. The water and spray sealant are supplied through respective supply hoses 100 and 102. The rotary union structure also carries a rotary switch actuator arm 104 and a pair of oppositely disposed limit switches and 106, 108 adapted to be contacted by the arm 180° intervals to terminate operation of the hydraulic motor 62 when the spray heads are respectively at opposite ends of their travel, as will be described in more detail below.

The front side components of the spray carriage may be housed in a casing structure 110 which may be internally heated for winter conditions, and the components on the rear side of the carriage may be protected from spray by a protector plate 112. Hoses 114 and 116 are provided for the supply and delivery of hydraulic fluid to and from the motor 62.

The hoses 100, 102 for supplying the spray heads 82, 84, and the hoses 114 and 116 for motor 62 extend from the spray carriage 44 through elongate flexible tubular sheath 120, the sheath extending over a pulley 122 on the outside of shaft 52 on the lift carriage 46. The other end of the sheath is secured to a manifold or like fitting 124 fixed to mast 28 (FIG. 2). Fitting 124 has connections to the respective hoses from a pressure fluid reservoir 126 (see FIG. 11*a*), a sealant tank 128 and a water tank 130 (see FIG. 11*b*). The sheath structure enables the hoses to be protected from the environment and, for example to be heated during winter conditions.

Figure 11A:
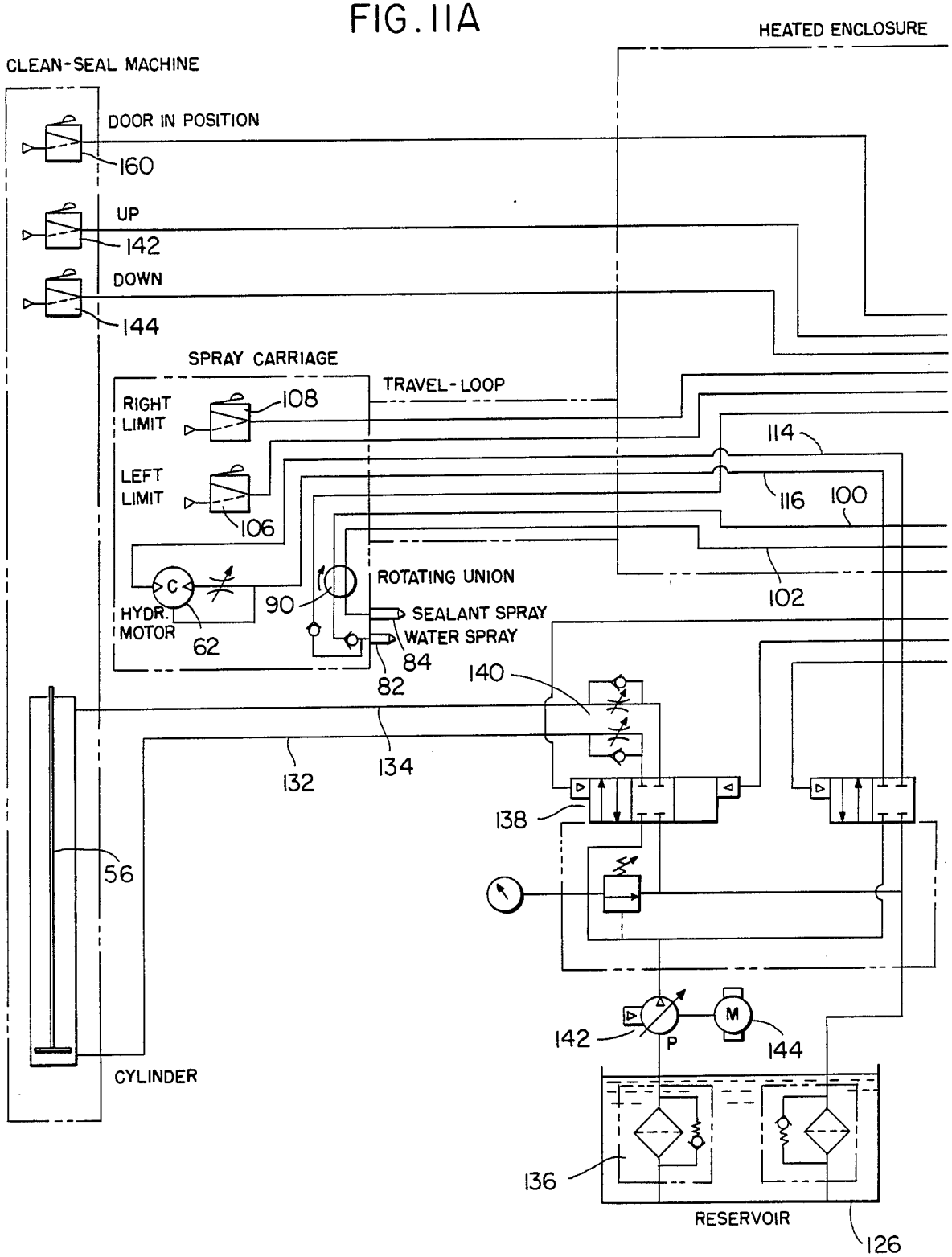
FIGS. 11*a* and 11*b* are left and right hand interconnecting sections respectively of a control circuit diagram for the machine.
Figure 11B:
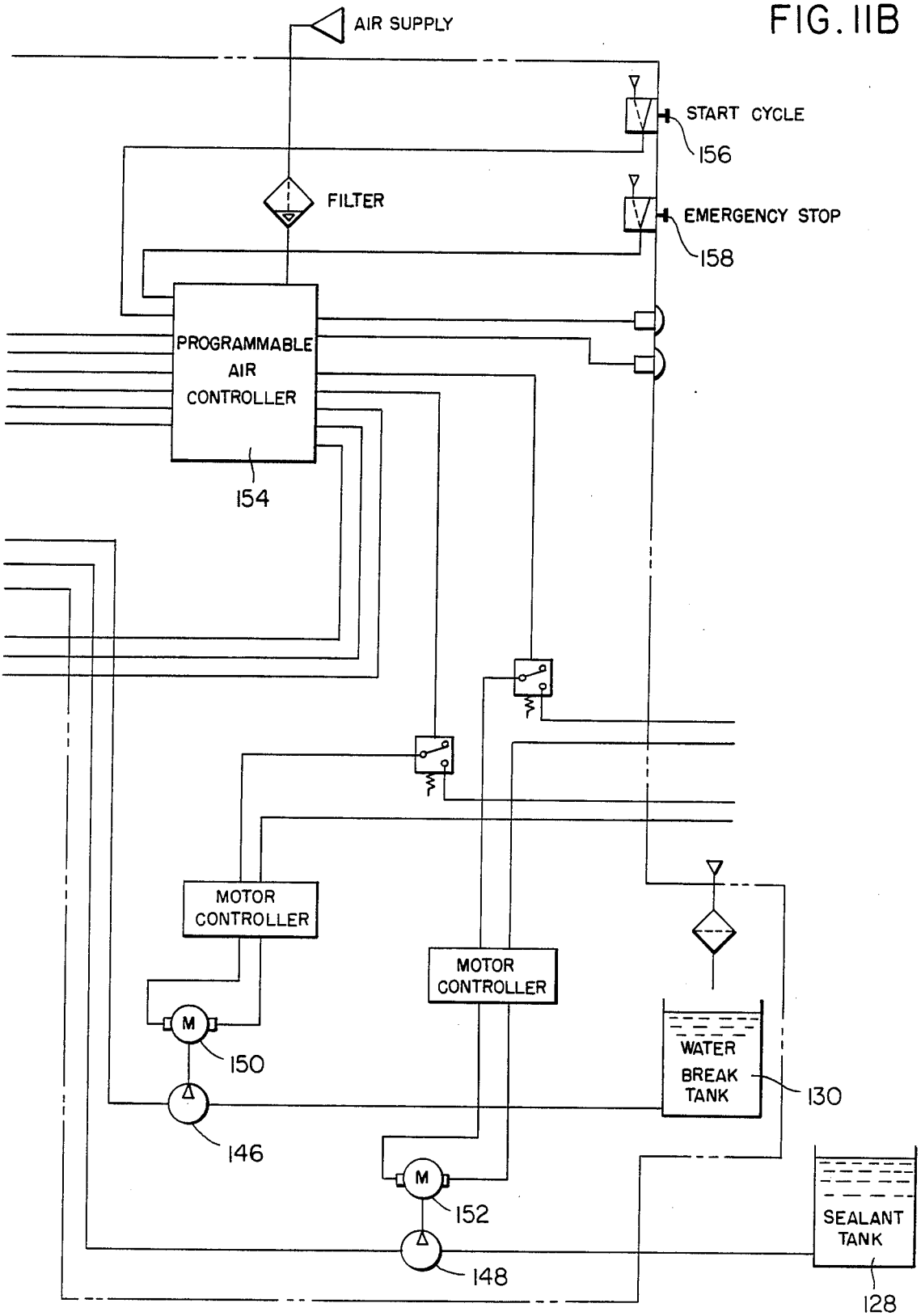

As shown in the control circuit diagram, FIGS. 11*a* and 11*b*, the hydraulic cylinder 56 has respective supply and delivery conduits 132, 134 which are used for the supply and delivery of hydraulic fluid from reservoir 126 through a suction strainer 136, a spool valve 138 and a throttle valve 140. A pump 142 and motor 144 are provided for the supply of hydraulic fluid from the reservoir. Up and down limit switches 142 and 144 are provided on mast 28 for terminating the up and down movement of the spray carriage pumps 146 and 148 are provided for delivering water under pressure and sealant under pressure respectively from the water tank and the sealant tank to the respective spray heads. The pumps are driven by respective motors 150, 152. Control of the respective motors and pumps is provided by way of the various limit switches in combination with a programmable air controller 154. The machine has a manual start button 156 and an emergency stop button 158. The circuit further includes a door position switch 160 for controlling overall operation of the circuit and preventing usage of the machine cycles in cases where a door is not properly in position.

The machine has three operational modes which may be selected by suitable selectors (not shown) in the programmable controller. The modes are respectively a clean and seal mode, a clean only mode and a seal only mode. The respective modes are selected by respective selectors (not shown) in the programmer controller. In any of the modes selected, the machine will only operate if the door is properly positioned as determined by the door position switch 160. On commencement of a spraying cycle, the spray carriage is at the bottom of the door with the spray heads aligned with the inner vertical edge of the door. When the start cycle switch 156 is depressed, and if the door position switch 160 is actuated, the cycle commences by initiating spraying through a respective one of the spray heads and operating the cylinder 56 to extend thereby moving the spray head up at the inner vertical edge of the door. When the spray head reaches the top of the door at commencement of the upper inner curved corner 16, the upper limit switch 142 is depressed initiating operation of the hydraulic motor 62. Accordingly, the spray head is traversed along the upper loop of the spray head conveyor 74 thereby traversing corner 16 of the door, the upper edge of the door, and also corner 18 of the door. When the corner 18 of the door has been traversed, limit switch 108 within the spray carriage is contacted by rotary arm 104 thereby terminating operation of motor 62 and simultaneously effecting retraction of cylinder 56 whereby the spray carriage descends so as to spray the outer vertical edge of the door. When the spray head reaches the commencement of lower curved corner 20, the lower limit switch 144 (which may alternatively be located in the cylinder 56) is depressed, thereby again effecting operation of hydraulic motor 62 to cause the spray head to traverse the lower loop of conveyor 74 thereby spraying corner 20 of the door, the lower edge of the door and corner 14. The spray head and spray carriage have returned to their initial positions and actuation of motor 62 is again terminated by engagement of the switch actuating arm 104 with limit switch 106.

It is evident that in the event of single mode operation, namely either cleaning only or sealing only, a single cycle of the apparatus will be effected using the requisite spray head and receiving spray from the respective tank 128 or 130. In the clean and seal mode, however, a cleaning cycle will be immediately be followed by a sealing cycle.

The cycle can be stopped in an emergency at any time by depressing the emergency stop button 158 and the cycle can be recommenced by retracting the emergency stop button.

While only preferred embodiment of the invention has been described herein detail, the invention is not limited thereby and modifications can be made within the scope of the attached claims.

I claim:

1. Apparatus for treating a coke oven door structure which has a perimeter with inner and outer longitudinal edges, transverse edges, and curved corners connecting the respective edges and around which perimeter a treatment head means is to be traversed, the apparatus comprising an elongate mast for positioning adjacent one longitudinal edge of the door, a treatment carriage mounted for reciprocal movement along the mast between respective terminal positions, the treatment carriage extending transversely from the mast, a treatment head means mounted on the carriage for movement therealong transversely with respect to the mast, first drive means for reciprocally moving the carriage along the mast whereby the treatment head means can transverse the one longitudinal edge of the door when the carriage is moved in one direction along the mast with the treatment head means at an inner position on the carriage with respect to the mast and whereby the treatment head means can traverse the other longitudinal edge of the door when the carriage is moved in a opposite direction along the mast with the treatment head means at an outer position on the carriage, and second drive means on the carriage for moving the treatment head means between the inner and outer positions along respective paths having profiles related to profiles of the respective transverse edges of the door and the curved corners at opposite ends of each transverse edge whereby the treatment head means is adapted to traverse one transverse edge of the door and the corners at opposite ends thereof when the carriage is stationary at one of said terminal positions on the mast and the treatment head means is adapted to traverse the other transverse edge of the door and the corners at the opposite ends thereof when the carriage is stationary at the other of said terminal positions on the mast.

2. The invention as defined in claim 1 wherein the second drive means comprises an endless drive element looped around spaced turning point members rotatably mounted on the treatment carriage, the treatment head means being carried by the drive element, the turning point members having respective diameters and a spacing therebetween which are related to the curvature of the corners of the door and the length of the transverse door edges in a manner providing movement of the treatment head means along said respective paths upon movement of the drive element along respective upper and lower loops defined by the turning point members, and the second drive means further including a drive member for effecting said movement of the drive element.

3. The invention as defined in claim 2 wherein the drive member comprises a drive motor for rotating one of said turning point members.

4. The invention as defined in claim 3 wherein the treatment head means includes at least one liquid spray head and the apparatus further includes supply means for delivering liquid to the spray head, the supply means including a rotary union on the treatment carriage between the turning point members, the rotary union having a stationary part and a rotary part, a delivery means for delivering spray liquid to the stationary part of the union, a supply hose for delivering spray liquid from the rotary part of the union to the spray head, and an actuator arm connected between the drive element and the rotary part of the union for rotating the rotary part of the union responsive to movement of the drive element so as to move the supply hose around in conjunction with the spray head.

5. The invention as defined in claim 4 including control means for said drive motor, the control means including switch means on the mast engageable by the treatment carriage for initiating operation of the motor when the carriage attains the respective terminal positions on the mast, oppositely disposed switches on the stationary part of said rotary union, and a switch actuator arm on the rotary part of the union for engaging the respective switches when the spray head comes to the respective ends of said paths to terminate operation of the motor.

6. The invention as defined in claim 2 wherein the second drive means includes a drive carriage mounted for reciprocal movement along the mast in spaced relation to the treatment carriage, an extensible and retractable piston-cylinder assembly having one end secured to the mast and another end secured to the drive carriage for moving the drive carriage along the mast responsive to extending and attracting movements of the assembly, a shaft with a rotary element on the drive carriage and a flexible connector element looped over the rotary element, the flexible element having one end connected to the mast and another end connected to the treatment carriage for moving the treatment carriage along the mast responsive to movements of the drive carriage therealong and at a predetermined rate relative to movement of the drive carriage.

7. The invention as defined in claim 6 wherein the treatment head means includes at least one liquid spray head and the apparatus includes supply means for supplying the spray head with liquid, the supply means including an assembly comprising a length of supply hose contained in an elongate flexible sheath, said assembly having one end attached to a first supply fitting and a opposite end attached to a second supply fitting on the treatment carriage, said shaft on the drive carriage having a further pulley thereon and said assembly being looped around said further pulley.

8. The invention as defined in claim 1 wherein the apparatus includes control means for operating the respective drive means in a manner providing a treatment cycle of the treatment head means around the perimeter of the door, the control means including a manual start switch for initiating operation of the first drive means effective to move the treatment carriage along the mast in said one direction from one of said terminal positions, a first limit switch on the mast for terminating operation of the first drive means and initiating operation of the second drive means to move the treatment head means from the inner position to the outer position when the treatment carriage attains the other of said terminal positions on the mast, a second limit switch on the treatment carriage for terminating operation of the second drive means and reinitiating operation of the first drive means to move the treatment carriage along the mast in said opposite direction along the mast when the treatment head means attains the outer position, a third limit switch on the mast for terminating operation of the first drive means and reinitiating operation of the second drive means to move the treatment head means from the outer position to the inner position when the treatment carriage reattains said one of said terminal positions on the mast, and a fourth limit switch on the treatment carriage for terminating operation of the second drive means when the treatment head means reattains the inner position.

9. The invention as defined in claim 8 wherein the treatment head means comprises a liquid spray head, the apparatus includes supply means for supplying liquid to the liquid spray head, wherein the manual switch is adapted to initiate operation of the supply means, and wherein the fourth limit switch is adapted to terminate operation of the supply means when the spray head reattains the inner position.

10. The invention as defined in claim 8 wherein the treatment head means includes a first spray head for a cleaning liquid and a second spray head for a sealing liquid, wherein the apparatus includes first supply means for supplying the first spray head with cleaning liquid, and second supply means for supplying the second spray head with sealing liquid, wherein the manual switch is adapted to initiate operation of the first supply means to provide a cleaning cycle of the apparatus and wherein the fourth limit switch is adapted to terminate operation of the first supply means thereby terminating the cleaning cycle, to initiate operation of the second supply means thereby initiating a sealing cycle of the apparatus, and to terminate operation of the second supply means on completion of the sealing cycle.

* * * * *